US007013936B2

(12) United States Patent
Schliemann et al.

(10) Patent No.: US 7,013,936 B2
(45) Date of Patent: Mar. 21, 2006

(54) DEVICE FOR DECANTING A LIQUID

(75) Inventors: Harald Schliemann, Waiblingen (DE); Hans Nickel, Cottenweiler (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 207 days.

(21) Appl. No.: 10/644,039

(22) Filed: Aug. 20, 2003

(65) Prior Publication Data

US 2004/0035895 A1 Feb. 26, 2004

(30) Foreign Application Priority Data

Aug. 23, 2002 (DE) ..... 102 38 752

(51) Int. Cl.
*B65B 1/04* (2006.01)

(52) U.S. Cl. ..... 141/353; 141/255; 141/264; 141/285; 141/292; 222/547

(58) Field of Classification Search ..... 141/192, 141/198, 255, 258, 284, 285, 290, 291, 292, 141/301, 309, 351, 352–355; 222/547, 564
See application file for complete search history.

(56) References Cited

U.S. PATENT DOCUMENTS 4,667,710 A * 5/1987 Wu ..... 141/198
5,416,378 A * 5/1995 Andrevski ..... 313/402
6,250,348 B1 6/2001 Reinholdt
6,435,380 B1 8/2002 Raboin

FOREIGN PATENT DOCUMENTS

| | | |
|---|---|---|
| DE | 100 17 863 | 10/2001 |
| EP | 0 103 600 | 2/1986 |
| EP | 0 569 222 | 5/1993 |

* cited by examiner

*Primary Examiner*—Timothy L. Maust
(74) *Attorney, Agent, or Firm*—Walter Ottesen

(57) ABSTRACT

An arrangement for decanting liquids includes a tubular-shaped support (1) having a flow channel (2). The flow channel (2) is blocked by a valve plate (3) which is coupled via axial connecting elements (4, 4') to the relative movement of an inner sleeve (5) and an outer sleeve (6) of the support (1). The outer sleeve (6) lies in overlapment and the axial connecting elements (4, 4') extend into the interior of the support. The valve plate (3) can be lifted from its valve seat against a spring force engaging at the inner sleeve (5) and at the outer sleeve (6). A radial flange collar (13) is formed on the outer sleeve (6). To ensure an accurate metering at the highest possible volume flow of the discharged liquid at low manufacturing costs, the valve plate (3) is mounted at a free end (9) of the support (1) and the axial connecting elements are configured as tension rods (4, 4') and are arranged next to an edge of the valve plate (3).

12 Claims, 3 Drawing Sheets

DEVICE FOR DECANTING A LIQUID

FIELD OF THE INVENTION

The invention relates to an arrangement for decanting liquids, especially fuels and lubricants.

BACKGROUND OF THE INVENTION

Decanting devices for preventing leaks are utilized when filling fuel or a lubricant, for example, into a supply vessel of an internal combustion engine provided therefor. The decanting device is introduced with a support into an opening of the vessel to be filled. The opening of the vessel is provided for this support.

European patent publication 0 103 600 discloses a cap for a liquid vessel which is configured as a hollow body having a flange collar and is seated on a central outlet opening of a supply vessel. The base of the cap lies in the outlet opening of the supply vessel. The periphery of the pot-shaped cap is provided with pass-through openings between the radial flange collar and the base of the cap. If the flange collar is pressed down upon a vessel, which is to be filled, by seating the cap, then the region of the cap, which is provided with the pass-through openings, is pushed into the interior of the supply vessel and so establishes a flow connection between the interior of the supply vessel and the cap. In this way, a filling can be undertaken in a position of the supply vessel with an outlet opening lying at the bottom as is usually the case when refilling engine oil in inaccessible openings of the internal combustion engine. An elastic bellows is mounted between the flange collar of the known closure cap and the cover of the supply vessel. In the normal position of the closure cap (that is, the closed position for the supply vessel), the bellows radially seals the interior space of the closure cap. The known closure cap may facilitate the filling of internal combustion engines with oil from small oil canisters; however, the supplied liquid quantity cannot be metered so that the problem occurs that the vessel, which is to be filled, can overflow. Furthermore, only an outflowing of the liquid is possible with a low volume flow.

German patent publication 100 17 863 discloses an arrangement for decanting the contents of vessels into other vessels and this arrangement is introduced with a tube-shaped support into a vessel opening provided therefor. To deliver a substance such as plant protective means of granular form, this known arrangement provides for a spring-actuated device wherein an inner sleeve and an outer sleeve of the support lie in overlapment and are displaceable against the spring force. In this way, openings can be brought into coincidence by axial or radial displacements of the inner sleeve and the outer sleeve so that the granular material from the supply vessel can enter into the support and finally into the vessel to be filled. A cover can also be provided which closes the outlet opening of the supply vessel in the interior thereof. The outlet opening is extended with a tubular shape and defines the interior sleeve which is surrounded by the separate and relatively movable component of the outer sleeve. Outer and inner sleeves are to be seated in the inlet opening of the vessel to be filled. The outer sleeve coacts with the cover via axial connecting pieces and displaces the cover via the axial slides into the interior of the supply vessel when there is a coaction of the inner and outer sleeves. By lifting the cover into the interior of the supply vessel, granulate from the supply vessel can be decanted. However, for the filling of liquids, such a device can be used only in a limited way or not at all because a controlled outflow without leakage cannot be effected. The known arrangement for filling the granulate is directed only to avoiding an overfilling of the vessel and, for reasons of continuity, a further afterflow of the granulate from the supply vessel is stopped in the state of a fully filled refill vessel. This procedure is only suitable for decanting solid granulate but not for liquids which would continue to flow out with a fully refilled vessel. Furthermore, a precise metering with the known device is not possible because the substance, which is already in the support, still arrives in the refill vessel.

SUMMARY OF THE INVENTION

It is an object of the invention to provide an arrangement for decanting liquids wherein a precise metering is ensured for the highest possible volume flow of the delivered liquid at low manufacturing costs.

The device of the invention is for decanting a liquid including fuel and lubricant into a vessel and includes: a tube-shaped support unit defining a flow channel and having a free end; a valve plate arranged at the free end and being movable between a first position wherein the flow channel is blocked and a second position wherein the flow channel is cleared to discharge the liquid into the vessel; the tube-shaped support unit including an outer sleeve and an inner sleeve telescopically mounted in the outer sleeve so as to permit the outer and inner sleeves to move relative to each other; resilient biasing means for providing a biasing force to resiliently bias the plate into the first position; the valve plate defining a peripheral edge and including first and second tie rods arranged on the valve plate adjacent the peripheral edge and the tie rods extending into the interior of the support unit; and, means for coupling the first and second tie rods to the relative movement of the inner and outer sleeves so as to permit the valve plate to be moved from the first position to the second position against the biasing force.

According to a feature of the invention, a valve plate is provided for blocking the flow path at a free end of the support. Tension rods are coupled to the relative movement of the inner and outer sleeves of the support and are provided next to the edge of the valve plate. The tension rods are provided for pressing the valve plate from its valve seat against the spring force. When the support is opened by pressing against the valve plate, then almost the entire cross section of the support is available for the discharge of the liquid so that a maximum volume flow can be achieved. In the decanting device of the invention, the volume flow is determined by the stroke of the valve plate, that is, the distance of the valve plate from its valve seat at the end of the support and the volume flow can be metered accurately in this way. To end the decanting operation, the pressure on the flange collar is reduced and the tension rods pull the valve plate against the valve seat under the action of the spring force whereby a further discharge of liquid is immediately prevented. In the configuration of the support of the invention, a further discharge of liquid is also automatically prevented as soon as the liquid level in the vessel reaches the support.

Preferably, two diametrically mounted tension rods are provided whereby the greatest possible flow cross section can be made available with a stable position and actuability of the valve plate. Advantageously, the tension rods are charged by the inner sleeve in the decanting device of the invention so that a compact configuration is provided. The tension rods are advantageously expandable and are equipped at their ends with radial catches for pressing and pulling the valve plate. The catches are latched in an undercut configured on the inner sleeve. In this way, the assembly of the decanting device is facilitated in that the valve plate with the pull rods formed thereon is inserted into the inner sleeve and there latches automatically. The valve plate with the tension rods is manufactured as a single piece in a preferred embodiment and is especially made of plastic as an injection molded part.

A further increase of the volume flow is possible by configuring one of the tension rods to have a radial opening in the region of the valve plate to which opening a venting line is connected which runs in the interior of the support. The venting line is led along the wall of the support interior and, in this way, further provides the optimal flow cross section of the support interior.

According to the invention, the outer sleeve surrounds the inner sleeve to form an annular space wherein a helical spring is mounted. In this way, the outer and inner sleeves can be manufactured with low manufacturing cost as parts which are inserted one into the other, for example, as injection molded parts. Seals which may be required can be seated in the annular gap for accommodating the helical spring. The inner sleeve is advantageously guided on the outer sleeve so that it cannot rotate with respect thereto in order to provide a more stable guidance of the inner sleeve in the outer sleeve and therefore a reliable actuation of the decanting device.

Advantageously, the connection and securing of the outer sleeve to the inner sleeve is achieved with a bayonet connection or the like. Here, it is advantageous to provide a rotational sleeve on the outer sleeve which engages over the inner sleeve with at least one radial catch. The inner sleeve here is accommodated in the outer sleeve.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
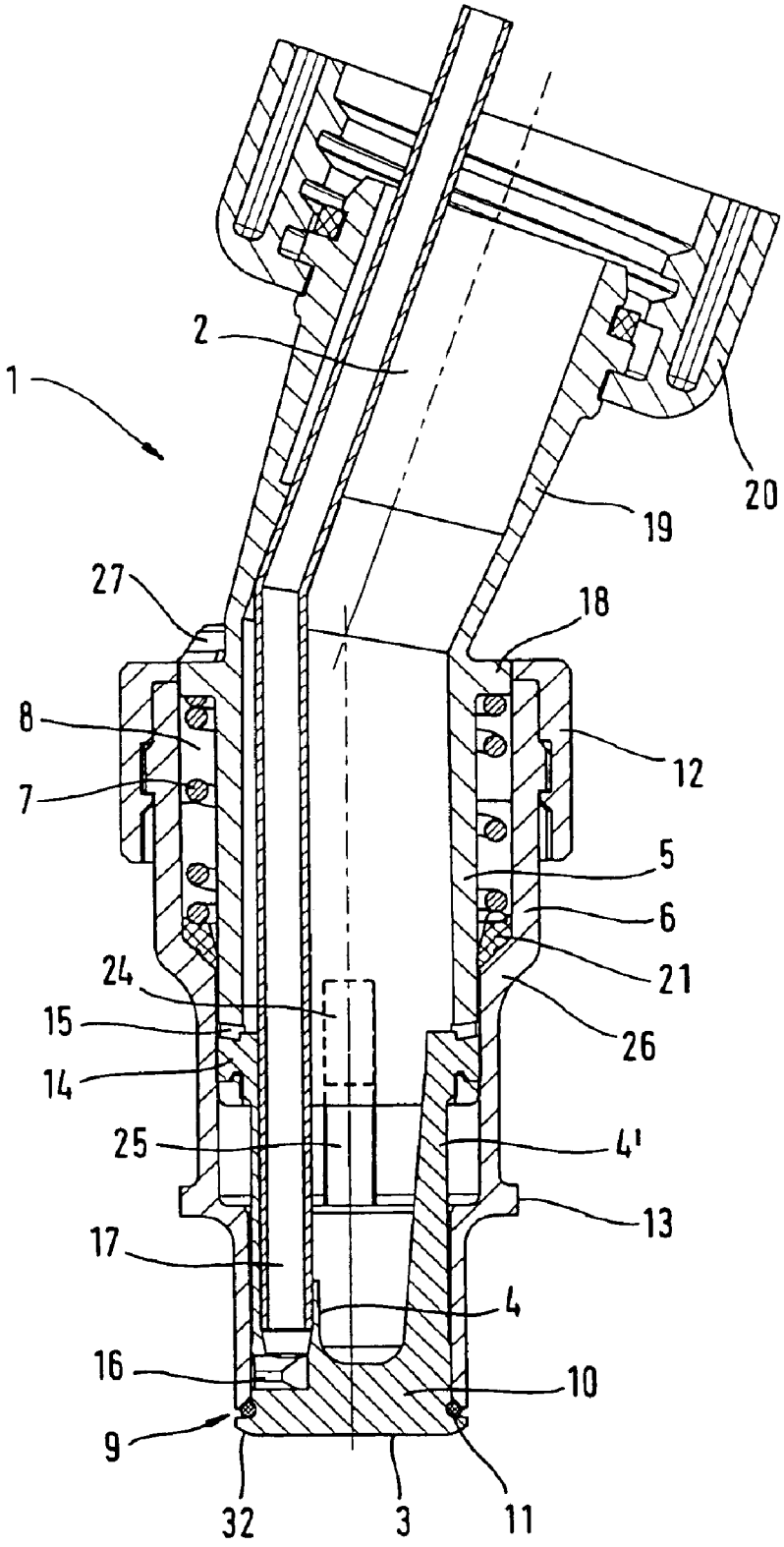
FIG. 1 is a side elevation view, in section, of the decanting device of the invention.

The device for decanting fluids shown in FIG. 1 includes a tubular-shaped support 1 whose flow channel 2 has an essentially homogeneous pass-through cross section in the interior and so permits an optimal discharge of the liquid toward the free end 9 of the support 1. A nut 20 for threadably pipe-connecting the support 1 to a supply vessel or a feed line for fuel or lubricating oil is provided at the upper end of the support. The free end 9 of the support is configured as a valve seat. The flow channel 2 is blocked by a valve plate 3 which lies against the free end 9 of the support with its edge 32 and with a sealing ring 11 disposed in between. For lifting the valve plate 3, an inner sleeve 5 is provided in the forward part reaching to the free end 9 of the support. The inner sleeve 5 is essentially rotationally symmetric and is inserted into the outer sleeve and lies segment wise in overlapment with the outer sleeve 6. The inner sleeve 5 is axially displaceable relative to the outer sleeve 6 and acts on the valve plate 3 against the return force of a helical spring 7. Two axial pull rods (4, 4') are configured diametrically opposite to each other on the valve plate 3. At their ends, the axial tension rods (4, 4') are subjected to an axial load by the inner sleeve 5. The tension rods (4, 4') are configured to be radially expandable and are provided with catches 14 which latch into an undercut 15 formed in the inner sleeve 5 when built in. In this way, a simple assembly of the valve can take place by pushing the same into the sleeve. The valve plate 3 and the tension rods (4, 4') can be cost-effectively manufactured as a common valve component 10, for example, as a plastic injection molded part.

The helical spring 7 acts on the inner sleeve to reset the same and therefore acts on the valve plate 3. For accommodating the helical spring 7, an annular space 8 is provided which is delimited by the outer sleeve 6 and the inner sleeve 5 pushed into the latter. On the side, which faces toward the free end 9 of the support, a constriction 26 of the outer sleeve 6 is provided for axially limiting the annular space 8; whereas, on the opposite-lying end of the annular space 8, a radial shoulder of the inner sleeve simultaneously forms the support for the helical spring 7. The shoulder 18 is configured with approximately the same diameter as the inner diameter of the part of the outer sleeve 6 which is expanded for the annular space 8 so that the inner sleeve is axially guided by the shoulder 18. Furthermore, and with a view toward a stable configuration and therefore reliable actuation of the decanting device, a device for preventing rotation of the inner sleeve in the outer sleeve 6 is provided which is formed by a guide cam projecting from the inner sleeve and this guide cam slides longitudinally in a corresponding slot 25 in the outer sleeve 6. The flow channel 2 in the interior of the support is separated by a seal 21 relative to the annular space 8 for accommodating the helical spring 7 so that a discharge of liquid from the support is precluded.

The forward part of the outer sleeve faces toward the liquid outlet at the free end 9 and is provided with a radial flange collar 13 with which the tube support 1 is supported on the edge of an opening of the vessel to be filled during a filling operation. After seating the flange collar 13, the inner sleeve 5 is displaced against the restoring force of the helical spring 7 by axial pressure on the tube support. The inner sleeve 5 presses the valve plate 3 from its valve seat via the tension rods (4, 4'). The discharge of fluid takes place reliably in a part of the support which is already disposed in the vessel to be filled. After releasing the pressure on the flange collar 13, the tension rods (4, 4') pull the valve plate 3 against the support 1 and immediately end the discharge of the liquid. In order to obtain the greatest possible throughput, one of the pull rods 4 is provided with a radial opening 16 whereat a venting line 17 is connected. In the valve component, a receptacle for the venting 17 (especially configured as a hose line) is provided so that a simple assembly of the hose line is possible which is only inserted into the receptacle in the valve component 10. The receptacle is provided in the axial direction of the support, that is, approximately perpendicularly to the radial venting bore 16 so that the hose line 17 for venting can be guided closely to the wall of the flow channel 2. In this way, an optimal flow cross section is provided in the interior of the support 1 and ensures a largest possible liquid throughflow as required.

The inner sleeve 5 is part of an angularly-configured tube. The part, which lies above the support section lying in overlapment with the outer sleeve, lies at an angle to the axis 32 of movement of the valve member 10. The hose line 17 is attached in the interior of the angle tube 19 with a clip connection.

The following can be configured as cost effective plastic components: the inner tube 19 having the inner sleeve 5 configured thereon for insertion into the outer sleeve 6; the outer sleeve 6 with the flange collar 13 formed thereon; and, the one-part valve component 10. The inner sleeve 5 and the outer sleeve 6 are connected to each other via a rotatable sleeve 12 guided on the outer sleeve. In this embodiment, the rotatable sleeve 12 is, for example, equipped with two catches 27 which, in the assembly position of the rotatable sleeve 12, overlap the shoulder 18 for applying force to the helical spring 7 and so hold the inner sleeve and the outer sleeve together.

Figure 2:
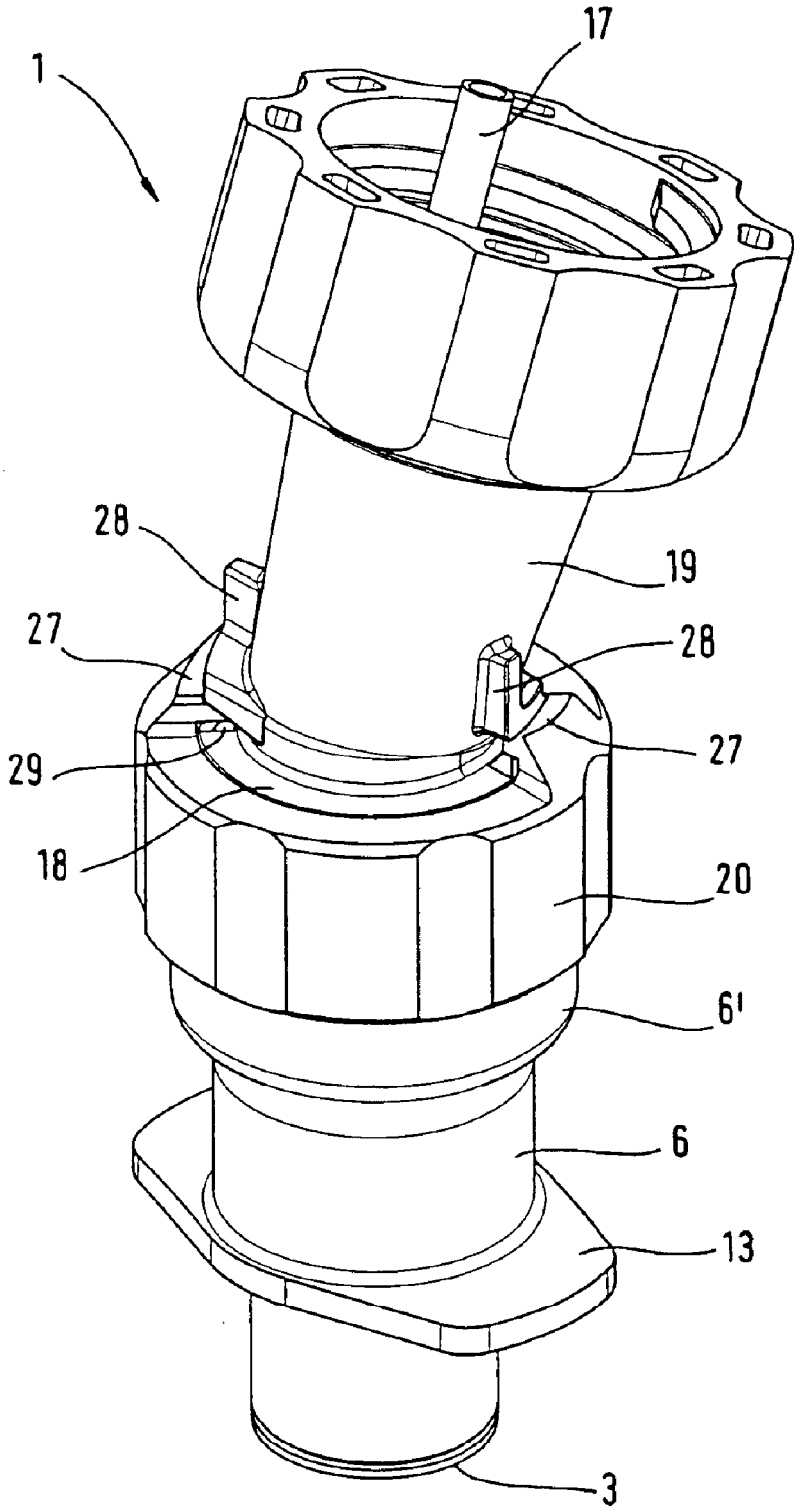
FIG. 2 is a perspective view of the decanting device of FIG. 1.

The connecting mechanism of the angle tube 19 and the outer sleeve 6 of the support by means of the rotatable sleeve 20 is explained in greater detail with respect to FIG. 2.

As shown in FIG. 2, breakthroughs 29 are provided in the shoulder 18 of the section of the angle tube 19 forming the inner sleeve. These breakthroughs 29 permit a passthrough of the catches 27. By rotating the rotatable sleeve 20 in the clockwise direction, the catches 27 are pushed next to guide ramps 28 which are formed as one piece on the angle tube 19. In the assembly position, the catches 27 are longitudinally guided on the guide ramps 28 when there is an axial movement of the angle tube 19 to press away the valve plate.

Figure 3:
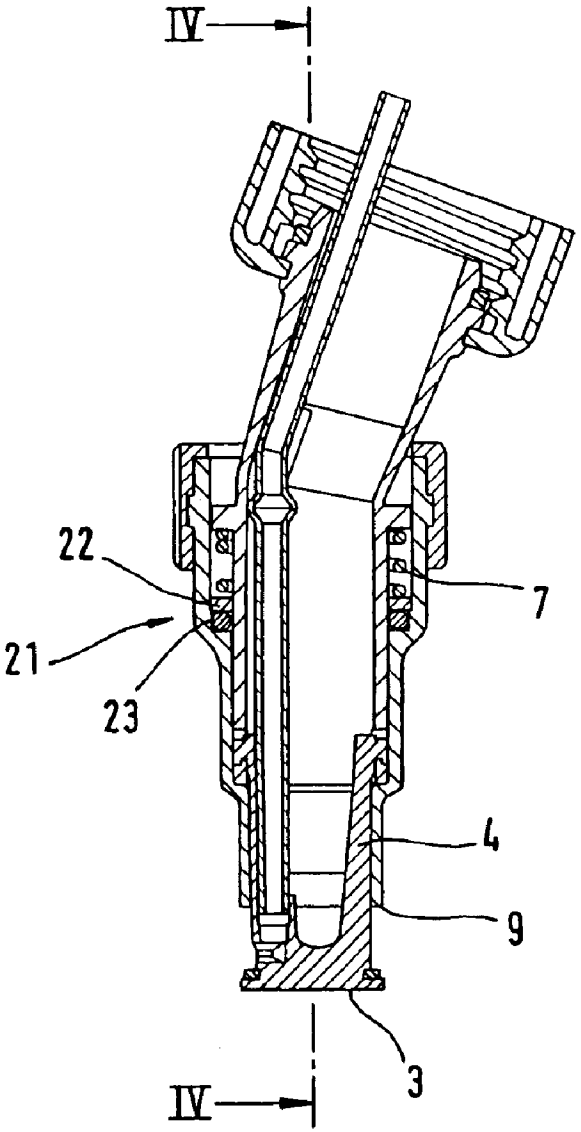
FIG. 3 is a section view of a decanting device in the open position.

FIG. 3 shows an arrangement for decanting oil in the opened state. The valve plate 3 is lifted from the valve seat on the free end 9 of the support 1. In the embodiment of a decanting device shown here, a seal 21 of the flow channel is formed in the support relative to the annular space for accommodating the helical spring 7 by an O-ring 27 and a disc 22 against which seal the helical spring 7 can be supported.

Figure 4:
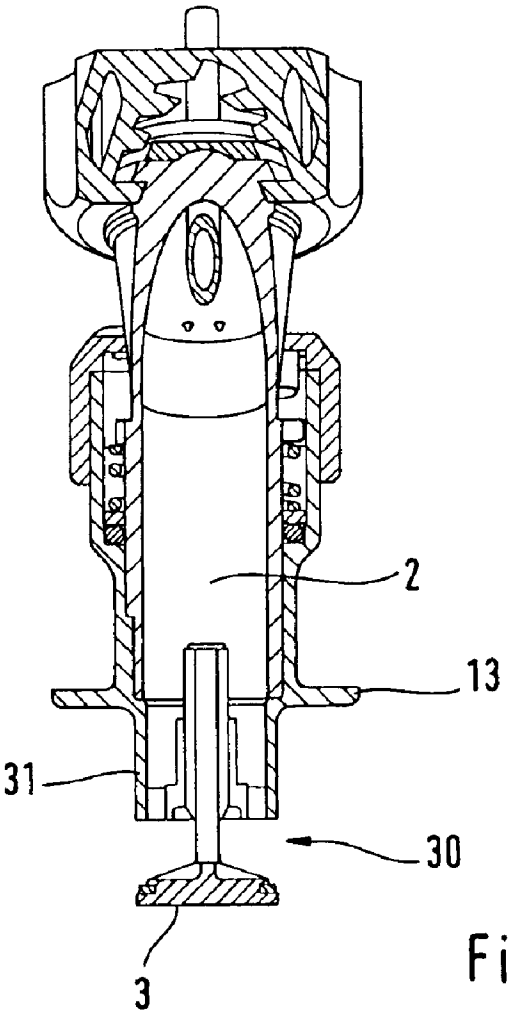
FIG. 4 is a section view taken along line IV—IV of FIG. 3 showing the decanting device in the open position.

FIG. 4 shows the large opening cross section of the decanting device according to the invention with the valve plate 3 lifted away from the valve seat. After the flange collar 13 is seated on the edge of a fill opening of the vessel to be filled and so can support the opening movement against the helical spring 7, a largest possible liquid quantity flows out from the flow channel through the section 31 of the support which projects into the vessel to be filled. A high liquid throughput is ensured also because of the venting introduced into the valve part.

It is understood that the foregoing description is that of the preferred embodiments of the invention and that various changes and modifications may be made thereto without departing from the spirit and scope of the invention as defined in the appended claims.

What is claimed is:

1. A device for decanting a liquid including fuel and lubricant into a vessel, the device comprising:

a tube-shaped support unit defining a flow channel and having a free end;

a valve plate arranged at said free end and being movable between a first position wherein said flow channel is blocked and a second position wherein said flow channel is cleared to discharge said liquid into said vessel;

said tube-shaped support unit including an outer sleeve and an inner sleeve telescopically mounted in said outer sleeve so as to permit said outer and inner sleeves to move relative to each other;

resilient biasing means for providing a biasing force to resiliently bias said plate into said first position;

said valve plate defining a peripheral edge and including first and second tie rods arranged on said valve plate adjacent said peripheral edge and said tie rods extending into the interior of said support unit;

means for coupling said first and second tie rods to the relative movement of said inner and outer sleeves so as to permit said valve plate to be moved from said first position to said second position against said biasing force;

one of said first tie rods having a radial opening formed therein in the region of said valve plate; and, said device further including a venting line running along the interior of said support unit and connected to said radial opening.

2. The device of claim 1, wherein said first and second tie rods lie diametrically opposite each other.

3. The device of claim 2, said coupling means being configured to couple said first and second tie rods to said inner sleeve so as to permit said inner sleeve to apply a force thereto.

4. A device for decanting a liquid including fuel and lubricant into a vessel, the device comprising:

a tube-shaped support unit defining a flow channel and having a free end;

a valve plate arranged at said free end and being movable between a first position wherein said flow channel is blocked and a second position wherein said flow channel is cleared to discharge said liquid into said vessel;

said tube-shaped support unit including an outer sleeve and an inner sleeve telescopically mounted in said outer sleeve so as to permit said outer and inner sleeves to move relative to each other;

resilient biasing means for providing a biasing force to resiliently bias said plate into said first position;

said valve plate defining a peripheral edge and including first and second tie rods arranged on said valve plate adjacent said peripheral edge and said tie rods extending into the interior of said support unit;

means for coupling said first and second tie rods to the relative movement of said inner and outer sleeves so as to permit said valve plate to be moved from said first position to said second position against said biasing force;

wherein said first and second tie rods lie diametrically opposite each other;

said coupling means being configured to couple said first and second tie rods to said inner sleeve so as to permit said inner sleeve to apply a force thereto; and said first and second tie rods being configured so as to be elastically expandable; and, said coupling means including: an undercut formed in said inner sleeve; and, first and second latching elements formed on the ends of said first and second tie rods, respectively, for latching into said undercut.

5. The device of claim 4, wherein said tie rods and said valve plate are formed as a single component.

6. The device of claim 5, wherein one of said first tie rods has a radial opening formed therein in the region of said valve plate; and, said device further comprises a venting line running along the interior of said support unit and connected to said radial opening.

7. The device of claim 6, wherein said outer sleeve and said inner sleeve conjointly define an annular space; and, said resilient biasing means being is a helical spring accommodated in said annular space.

8. The device of claim 7, wherein said inner sleeve has a radial shoulder formed thereon for axially delimiting said annular space at one axial end thereof and said outer sleeve is formed to have a constrictive portion at the end thereof facing toward said free end of said support unit so as to delimit said annular space at the other axial end thereof.

9. The device of claim 8, wherein said radial shoulder has a diameter which corresponds essentially to the diameter of said annular space and said constricted portion has a diameter corresponding essentially to the diameter of said inner sleeve.

10. The device of claim 7, wherein said device further comprises means for movably guiding said inner sleeve on the inner side of said outer sleeve so as to facilitate said relative movement and to prevent said outer sleeve and said inner sleeve from rotating relative to each other.

11. The device of claim 8, wherein said device further comprises a rotatable sleeve guided on said outer sleeve and having at least one radial latch for engaging over said radial shoulder of said inner sleeve; and, said radial latch and said radial shoulder conjointly define a bayonet connection.

12. The device of claim 11, wherein said device further comprises a breakthrough for assembly in said radial shoulder for said radial latch.

* * * * *

UNITED STATES PATENT AND TRADEMARK OFFICE

CERTIFICATE OF CORRECTION

PATENT NO. : 7,013,936 B2 
APPLICATION NO. : 10/644039
DATED : March 21, 2006
INVENTOR(S) : Harald Schliemann and Hans Nickel It is certified that error appears in the above-identified patent and that said Letters Patent is hereby corrected as shown below:

In the Title Page:

Under (56) References Cited: delete "5,416,378 A * 5/1995 Andrevski…….313/402" and substitute -- 5,419,378 * 5/1995 Law -- therefor.

Under (56) References Cited: insert -- 6,478,058 * 11/2002 Pears -- after "6,435,380 B1 8/2002 Raboin".

In column 6:

Line 26: delete "and" and substitute -- and, -- therefor.

Line 41: delete "being".

Signed and Sealed this

Nineteenth Day of September, 2006

JON W. DUDAS
*Director of the United States Patent and Trademark Office*